US005676063A

United States Patent [19]

Wallace

[11] Patent Number: 5,676,063

[45] Date of Patent: Oct. 14, 1997

[54] MODULAR PALLET

[75] Inventor: David W. Wallace, Rosyth, Scotland

[73] Assignee: NCR Corporation, Dayton, Ohio

[21] Appl. No.: 592,978

[22] Filed: Jan. 29, 1996

[30] Foreign Application Priority Data

Oct. 13, 1995 [GB] United Kingdom ..... 9521022

[51] Int. Cl.[6] ..... B65D 19/00

[52] U.S. Cl. ..... 108/51.1; 108/55.3; 108/56.1

[58] Field of Search ..... 108/51.1, 55.1, 108/55.3, 55.5, 56.1, 56.3; 248/346.02, 346.03

[56] References Cited

U.S. PATENT DOCUMENTS

| | | | |
|---|---|---|---|
| 2,461,479 | 2/1949 | Moffat | 108/51.1 X |
| 2,895,695 | 7/1959 | Solomon . | |
| 4,079,907 | 3/1978 | Mykleby | 108/56.1 X |
| 4,128,253 | 12/1978 | Powers | 108/55.1 X |
| 4,165,806 | 8/1979 | Cayton | 108/55.1 X |
| 4,319,530 | 3/1982 | Moog | 108/56.1 X |
| 4,660,796 | 4/1987 | Garrec | 108/55.1 X |
| 5,180,134 | 1/1993 | Mallak | 108/55.1 X |
| 5,505,140 | 4/1996 | Wittmann | 108/55.1 X |

FOREIGN PATENT DOCUMENTS

| | | | |
|---|---|---|---|
| 0692431 | 1/1996 | European Pat. Off. . | |
| 2588832 | 4/1987 | France | 108/51.1 |
| 671203 | 8/1989 | Switzerland | 108/51.1 |
| 921612 | 3/1963 | United Kingdom . | |
| 9511167 | 10/1994 | WIPO . | |

*Primary Examiner*—Peter M. Cuomo
*Assistant Examiner*—Janet M. Wilkens
*Attorney, Agent, or Firm*—Michael Chan

[57] ABSTRACT

A modular pallet (10) comprises a pair of cushion bars (12,14), and a pair of spaced sub-frames (22,24), each having a horizontal support surface (26,38) with a pair of slots (34,36 and 50,52) in its front or rear edge, the sub-frames also having vertical supports (30,32,44,46) parallel to the cushion bars 12,14. In use, an object (58) to be carried is bolted by bolts passing through weldnuts (64) in its floor and through the slots (34,36,50,52) into threaded apertures in the cushion bars (12,14); the pallet (10) is taken by a pallet trolley to a required position, the bolts undone, and the cushion bars (12,14) removed. The trolley then lowers the remaining sub-frames (22,24) of the pallet and is removed. Jacking studs (62) are inserted in the weldnuts (64) to raise the object (58) from the sub-frames (22,24), which are then removed by sliding so that the slots (34,36,50,52) slide with respect to the jacking studs (62). The object is then lowered on the jacking studs. The pallet (10) is suitable for the installation off heavy apparatus such as self-service terminals or automated teller machines (ATMs).

13 Claims, 4 Drawing Sheets

MODULAR PALLET

BACKGROUND OF THE INVENTION

This invention relates to pallets, that is, devices for transporting goods which are co-operable with a pallet trolley or a fork lift truck.

Pallets are usually of sturdy wooden construction, and are used to transport heavy and bulky goods. The goods are then removed for storage or for installation in an operating position; in such a position, they often require to be precisely aligned; for example self-service terminals, such as automated teller machines (ATMs) for banking operations, are transported by pallet, then removed for installation at required positions in bank premises. The terminals must be manhandled into place and, as they are heavy and have a high centre of gravity, there is a risk of them toppling and causing injury or damage.

It is known to provide a pallet which can be dismantled, such as that described in the specification of International Patent Application No. WO 95/11167, but such a pallet can be dismantled only after removal of the goods which have been transported on it.

SUMMARY OF THE INVENTION

It is an object of the invention to provide a modular pallet which allows the transported goods to be accurately positioned, with minimum risk of injury to the operator, and which can be dismantled, all by a single person.

According to the invention a modular pallet comprises a pair of spaced, parallel, elongated support members, each having at least two fixing apertures in its upper surface; and a pair of sub-frames, each comprising a horizontal support surface transverse to and above the support members; and below the support surfaces a plurality of spaced vertical supports parallel to the support members, each support surface having, in an edge transverse to the support members, a pair of slots, the slots being alignable with respective fixing apertures in the support members.

Preferably the height of the pair of support members and of the vertical supports of the sub-frames is sufficient to allow access to the fork of a fork lift means such as a pallet trolley or a fork lift truck.

Preferably the vertical supports on each sub-frame are located inside the pair of support members at such a spacing as to allow the fork of a pallet trolley or fork lift truck to pass between the vertical supports and the pair of support members.

Preferably the fixing apertures in the support members are threaded, whereby the sub-frames can be fixed to the support members by bolt means passing through the slots in the support surfaces.

Preferably the modular pallet is constructed so that in use the sub-frames can be raised by fork lift means co-operable with the undersides of the support surfaces, whereby the pair of support members can be removed, and the sub-frames lowered to be supported by their respective vertical supports.

Preferably the modular pallet is constructed so that an object supported by the horizontal support surfaces of the sub-frames can be raised by jacking means passing through the pair of slots in each support surface, and the frames removed by sliding so that the respective slots slide with respect to the jacking means.

The jacking means may be jacking studs passing through the respective slots.

BRIEF DESCRIPTION OF THE DRAWINGS

The invention will now be described by way of example only with reference to the accompanying drawings in which.

DETAILED DESCRIPTION

Figure 1:
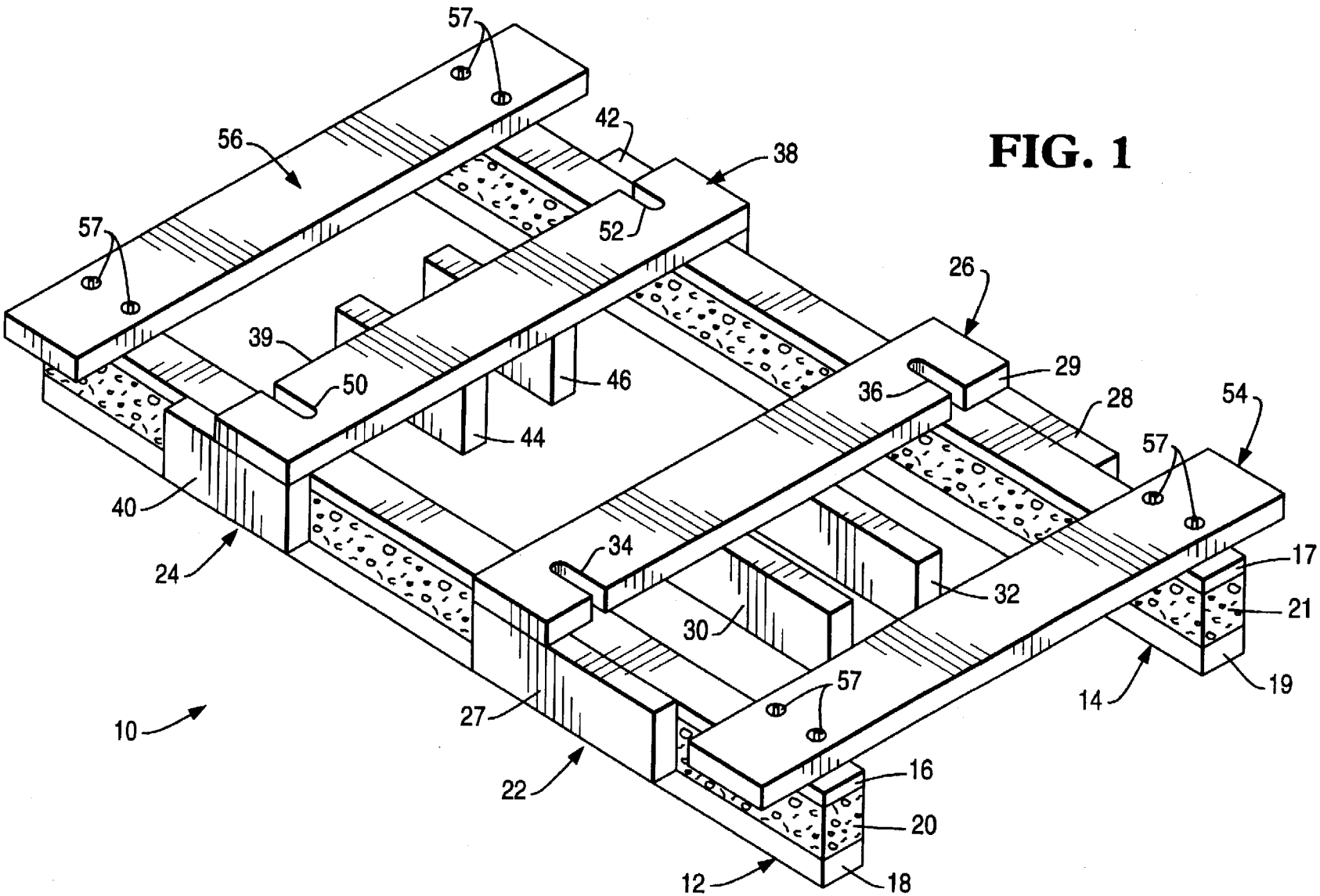
FIG. 1 is a perspective view of a modular pallet according to the invention.
Figure 2:
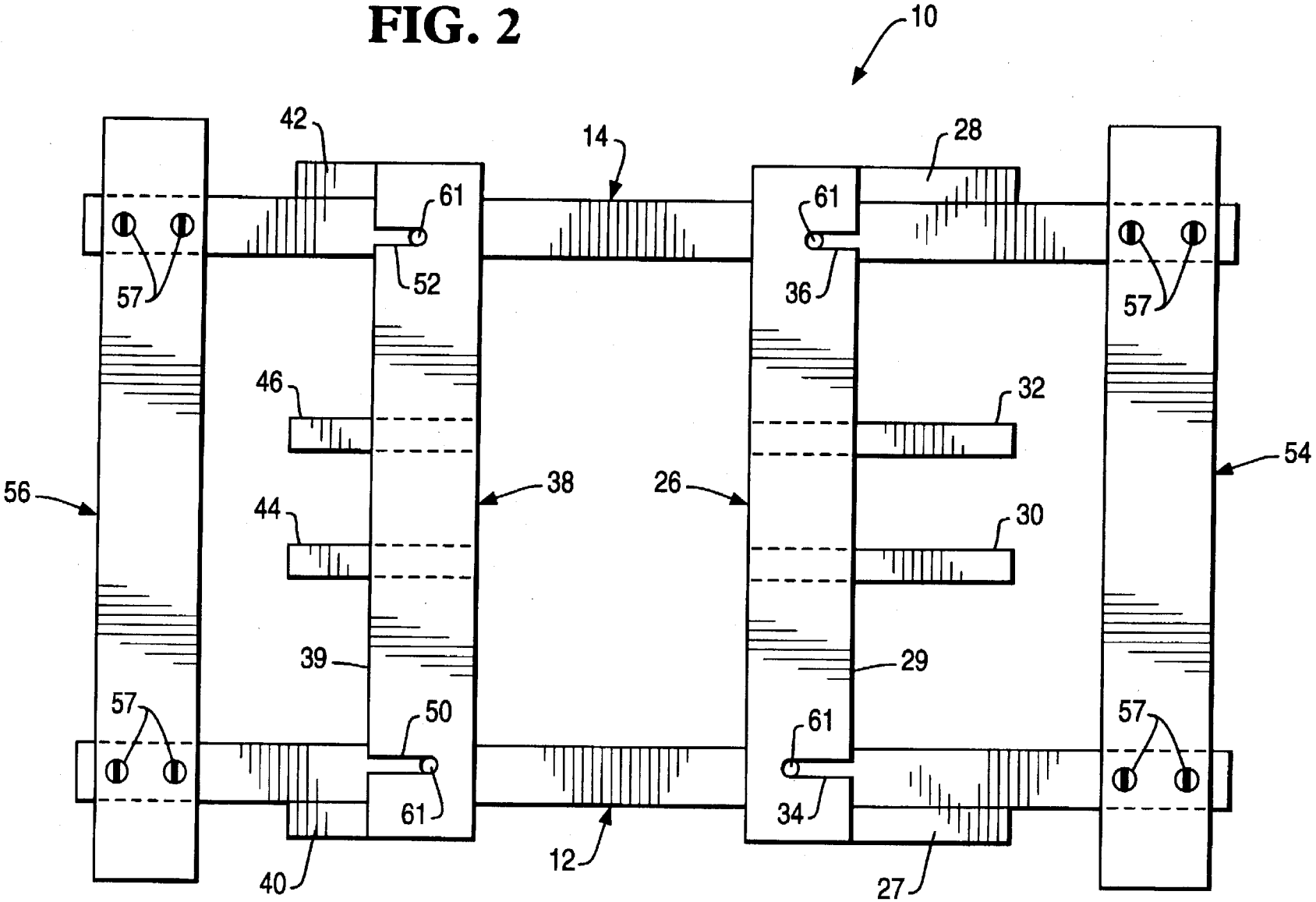
FIG 2 is a top view of the pallet shown in FIG. 1.

Referring first to FIGS. 1 and 2, a modular pallet 10 comprises two spaced parallel support members 12,14, comprising an elongated construction with respective upper wooden strips 16,17 and lower wooden strips 18,19 with layers of resilient foam material 20,21 between them. The foam material 20,21 absorbs vibrations in transit, and the support members 12,14 will be referred to herein as cushion bars.

Across the top surfaces of the cushion bars 12,14 lie front and rear sub-frames indicated generally as 22,24. Front sub-frame 22 comprises a horizontal support surface 26 which extends over the cushion bars 12,14, and carries two downwardly-extending vertical supports 30,32 which are parallel to the cushion bars 12,14. The supports 30,32 are positioned between the cushion bars, and extend forward of an edge 29 of the support surface 26 to provide stability to the sub-frame. The sub-frame also carries two further downwardly-extending side pieces 27,28 positioned closely outside the cushion bars 12,14; the side pieces also extend forward of the support surface 26. The front edge 29 of the support surface 26 has two slots 34,36 extending parallel to the cushion bars 12,14.

The rear sub-frame 24 is of similar construction, but of mirror image form, i.e. having a horizontal support surface 38 with side pieces 40,42, vertical supports 44,46, extending rewardly beyond the rear edge 39 of the support surface 38, and slots 50,52, with the slots 50,52 being in the rear edge 39 of the support surface 38.

At the front ends of the cushion bars 12,14 there is a front space bar 54, and at the rear ends there is a rear space bar 56. The space bars are screwed to the respective cushion bars 12,14 by screws 57. Except for the foam layers 20,21 the pallet 10 is made of wood. The dimensions are such that the forks of a pallet trolley can pass below the horizontal support surfaces 26,38, with one fork between the inner sides of the cushion bars 12,14 and the respective vertical supports 30,32 and 44,46. It will be appreciated that a pallet trolley includes an extending fork movable vertically by a jacking mechanism. The space bars 54, 56 are removed to enable the extending fork of the pallet trolley to be inserted into the pallet.

Figure 3:
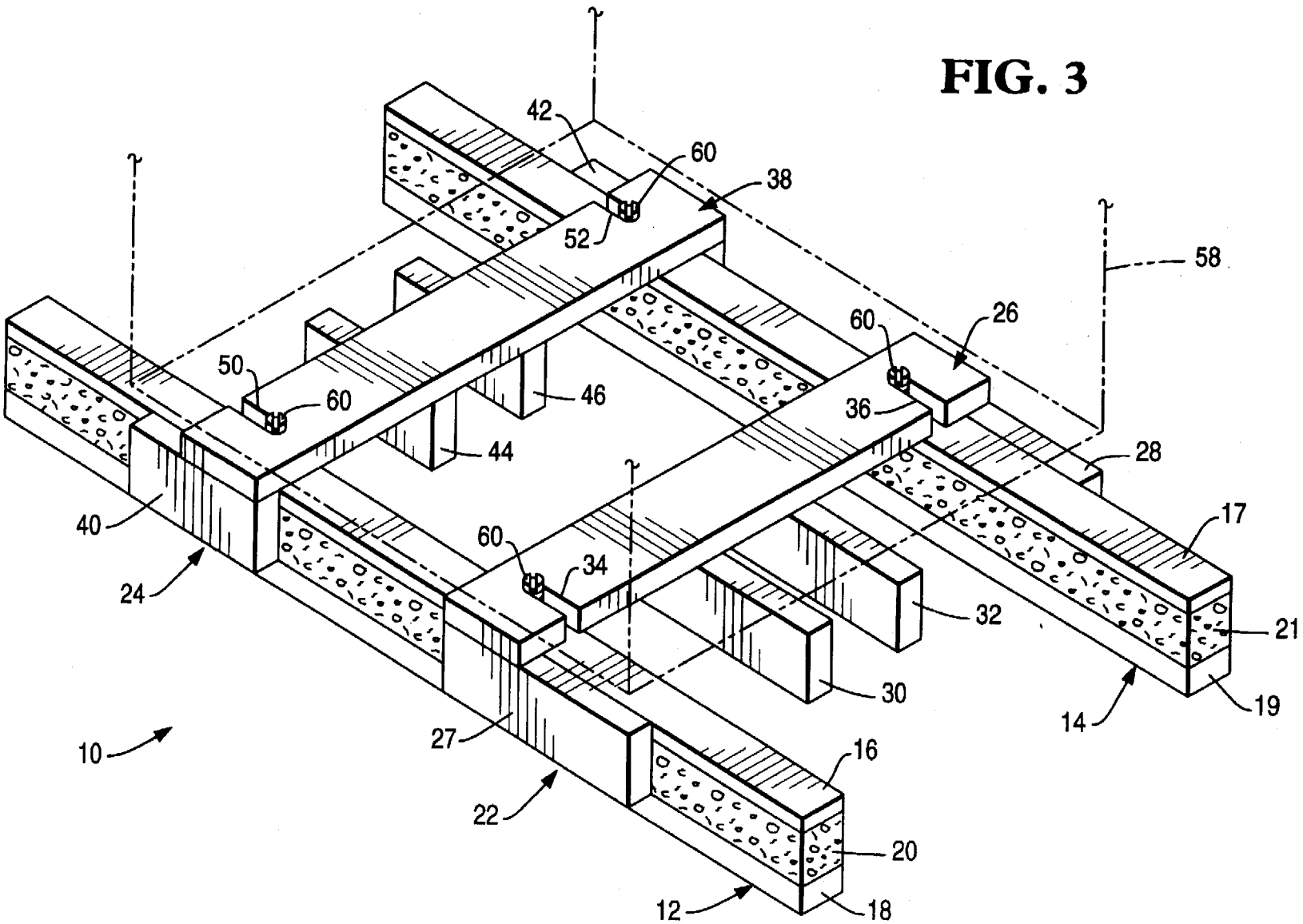
FIG. 3 illustrates schematically an ATM in position on a pallet.

FIG. 3 shows the pallet without the space bars 54,56, and with an ATM 58 in place, the lower position of which is indicated in dashed outline. The base of the ATM is supported on the support surfaces 26,38, and bolts 60 pass through weld nuts (not shown in this Figure) in the floor of the ATM 58, and through the slots 34,36,50,52, into threaded apertures 61 (FIG. 2) in the top layers 16,17 of the cushion bars 12,14. The bolts hold the ATM 58 on the pallet 10, and also fix the sub-frames 22,24 to the cushion bars 12,14. The side pieces 27,28,40,42 outside the cushion bars assist in holding the cushion bars 12,14 at right angles to the sub-frames 22,24.

It will be clear that the bolts 60 are inserted from inside the ATM 58, access being effected through a door (not shown) in the ATM 58. The ATM can then be transported on the pallet 10 by use of a single-person operated pallet trolley to an installation location. The fork arms (not shown) of the pallet trolley pass between the vertical supports 30,32,44,46 and the cushion bars 12,14. The ATM, still on the pallet 10, is placed in the required position, which may for example be in a corner with access only from the side and the rear (bank access side) of the ATM.

With the pallet 10 still elevated on the pallet trolley, the bolts 60 are removed via the inside of the ATM 58; this releases the cushion bars 12,14, which can be withdrawn in a direction parallel to their length. The trolley jacking mechanism is then operated to lower the sub-frames 22,24 so that the vertical supports 30,32,44,46 and the side pieces 27,28,40,42, rest on the floor, supporting the horizontal surfaces 26,38 on which the ATM 58 rests.

It will be clear that the ATM is not at any time tilted, the conventional jacking mechanism of the pallet trolley being used to lower the remaining modules of the pallet so that the ATM is in the correct position. The pallet trolley is then removed completely.

Figure 4:
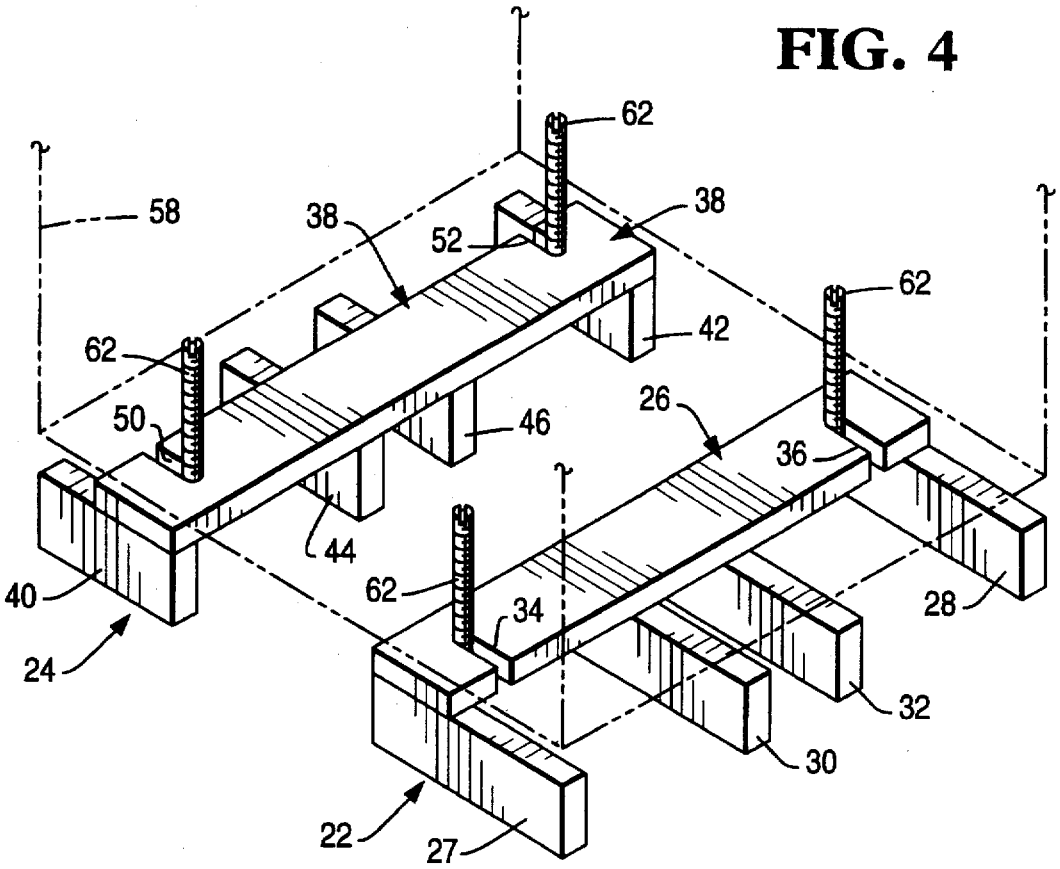
FIG. 4 illustrates the use of jacking screws to raise an ATM from the sub-frames of a pallet.
Figure 5:
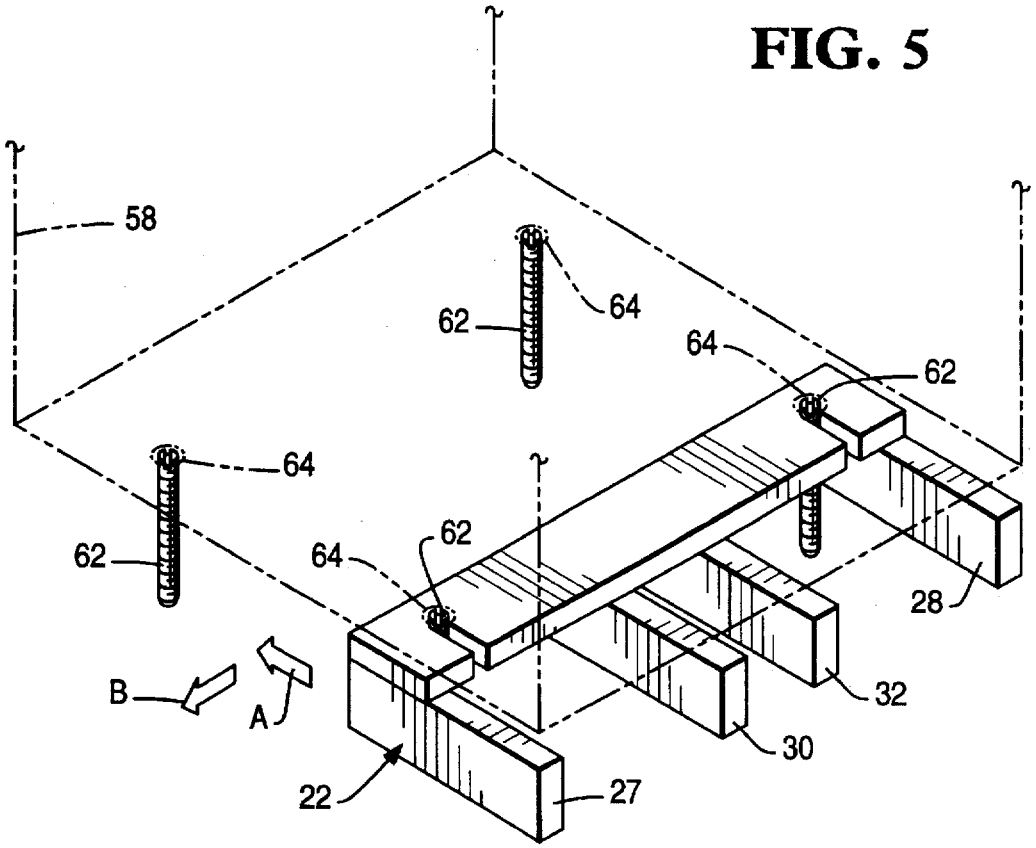
FIG. 5 illustrates removal of the final sub-frame of the pallet.

The next stage of installation is shown in FIG. 4. Jacking studs 62 are placed in the weld nuts (not shown) in the floor of the ATM 58 in the positions formerly occupied by the bolts 60. By use of the jacking studs, operable for example by a large screwdriver, the ATM 58 is raised while keeping it very largely horizontal so that its weight is taken by the jacking studs 62 and its underside is clear of the support surfaces 26,38. The jacking studs pass through the slots 34,36,50,52. The sub-frames 22,24 can now be removed by sliding them so that the slots move relative to the jacking studs 62. This is illustrated in FIG. 5, which shows the ATM 58 supported on the jacking studs 62 in the weldnuts 64, with the arrows A and B indicating the consecutive directions of movement of the front sub-frame 22. After a short movement in the direction of arrow A, the sub-frame is clear of the jacking studs 62 and can be removed in the direction of arrow B. The rear sub-frame is not illustrated.

The ATM 58 is now supported on the four jacking studs 62. Access to the inside of the ATM allows it to be lowered on the studs 62, and kept largely horizontal, until its base rests on the floor. The jacking studs 62 can then be removed, and the ATM brought into normal operation.

Installation of the ATM 58 and removal of the pallet 10 can be achieved by a single person, without the need to tilt the ATM, and therefore with greatly improved safety. The pallet 10 can be reassembled for further use.

Reference to FIGS. 1 and 2 will show that the front and rear space bars 54,56 do not support the ATM, but provide protection against impact damage and also strengthen the pallet 10 generally. The bars 54,56 also serve to assist in positioning a cardboard box cover (not shown) which may be placed over the ATM 58 and extend over the space bars 54,56 to serve as a protective cover during transit of the ATM. The protective cover may be stapled to the space bars 54,56.

In variations of the described embodiment, the raising and lowering of the ATM 58 with respect to the sub-frames 22,24 can be achieved by operating the jacking studs 62 by use of a worm and wheel reduction gear box, or a flexible drive attached to a drill or electric screw driver. The jacking studs 62 may be provided with feet to avoid marking the floor, or with castors to provide easy movement of the ATM in future use. Instead of being made of wood, the pallet 10 could be made of other suitable material, such as a rigid plastics material, or of metal, for example.

What is claimed is:

1. A modular pallet comprising:

a pair of spaced, parallel, elongated support members, each support member having an upper surface and at least two fixing apertures in the upper surface; and a pair of sub-frames, each sub-frame including (i) a horizontal support surface which extends transverse to and above the support members, (ii) an edge surface which extends transverse to the horizontal support surface and the support members, and (iii) surface means defining a pair of grooved slots in the edge surface such that the grooved slots are alignable with respective fixing apertures in the support members.

2. A modular pallet according to claim 1, wherein the grooved slots of each sub-frame enables the sub-frame to slide freely away from jacking studs extending through the grooved slots.

3. A modular pallet according to claim 1, wherein the grooved slots of one sub-frame faces a first direction and the grooved slots of the other sub-frame faces a second direction which is opposite the first direction.

4. A modular pallet according to claim 1, wherein each sub-frame includes a plurality of spaced vertical supports, each vertical support extending parallel to the support members and below the horizontal support surfaces of the sub-frames.

5. A modular pallet according to claim 4, wherein the height of the pair of support members and the height of the vertical supports of the sub-frames are sufficient to allow access to a fork of a fork lift.

6. A modular pallet according to claim 5, wherein the vertical supports of each sub-frame are located inside the pair of support members at such a spacing as to allow the fork of the fork lift to pass between the vertical supports and the support members.

7. A modular pallet according to claim 6, wherein each sub-frame includes a pair of vertical supports located outside and closely adjacent the support members.

8. A modular pallet according to claim 4, wherein the sub-frames are adapted to be raised by a fork lift co-operable with undersides of the sub-frames, the support members being removable and the sub-frames being lowerable to a position so as to be supported on their respective vertical supports.

9. A modular pallet according to claim 1, wherein the fixing apertures in the support members are threaded apertures such that the sub-frames can be fixed to the support members by bolts passing through the grooved slots of the sub-frames into the threaded apertures.

10. A modular pallet comprising:

a pair of spaced, parallel, elongated support members, each support member having an upper surface and at least two fixing apertures in the upper surface; and a pair of sub-frames, each sub-frame including a horizontal support surface which extends transverse to and above the support members, each support surface having (i) an edge which extends transverse to the support members and (ii) a pair of slots in the edge such that the slots are alignable with respective fixing apertures in the support members;

each sub-frame including a plurality of spaced vertical supports, each vertical support extending parallel to the support members and below the support surfaces;

each support member having a sandwich construction comprising upper and lower rigid layers with resilient layers therebetween.

11. An apparatus for enabling an object to be transported, the apparatus comprising:

a pair of spaced, parallel, elongated support members, each support member having an upper surface and at least two fixing apertures in the upper surface;

a pair of sub-frames, each sub-frame including a horizontal support surface which extends transverse to and above the support members, each support surface having (i) an edge which extends transverse to the support members and (ii) a pair of slots in the edge such that the slots are alignable with respective fixing apertures in the support members;

each sub-frame including a plurality of spaced vertical supports, each vertical support extending parallel to the support members and below the support surfaces;

the sub-frames being adapted to be raised by a fork lift co-operable with undersides of the support surfaces of the sub-frames, the pair of support members being removable and the sub-frames being lowerable to a position so as to be supported on their respective vertical supports; and jacking means passing through the slots in the support surfaces of the sub-frames and for raising an object from a position supported by the support surfaces to a raised position.

12. An apparatus according to claim 11, wherein the slots in each support surface enable the respective sub-frame to be removed by sliding the sub-frame relative to the jacking means when the object is in the raised position.

13. An apparatus according to claim 12, wherein the jacking means includes a plurality of jacking studs passing through respective slots.

* * * * *